US010264861B2

(12) United States Patent
Su

(10) Patent No.: US 10,264,861 B2
(45) Date of Patent: Apr. 23, 2019

(54) WIND-PROOF UMBRELLA

(71) Applicant: Yen-Shuo Su, Hsin-Chu (TW)

(72) Inventor: Yen-Shuo Su, Hsin-Chu (TW)

( * ) Notice: Subject to any disclaimer, the term of this patent is extended or adjusted under 35 U.S.C. 154(b) by 0 days.

(21) Appl. No.: 15/464,655

(22) Filed: Mar. 21, 2017

(65) Prior Publication Data

US 2018/0271238 A1 Sep. 27, 2018

(51) Int. Cl.

| | |
|---|---|
| ***A45B 25/22*** | (2006.01) |
| ***A45B 25/06*** | (2006.01) |
| ***A45B 25/02*** | (2006.01) |
| ***A45B 19/00*** | (2006.01) |

(52) U.S. Cl.

CPC ..... *A45B 25/22* (2013.01); *A45B 19/00* (2013.01); *A45B 25/02* (2013.01); *A45B 25/06* (2013.01)

(58) Field of Classification Search

CPC ..... A45B 25/22

See application file for complete search history.

(56) References Cited

U.S. PATENT DOCUMENTS

| | | | | | |
|---|---|---|---|---|---|
| 539,762 | A * | 5/1895 | Barnett | A45B 25/22 | 135/27 |
| 786,471 | A * | 4/1905 | Wallace | A45B 25/22 | 135/27 |
| 1,167,431 | A * | 1/1916 | Raabe | A45B 25/22 | 135/27 |
| 6,186,157 | B1 * | 2/2001 | Lin | A45B 25/22 | 135/25.1 |
| 6,588,439 | B2 * | 7/2003 | Wu | A45B 19/10 | 135/27 |
| 6,863,081 | B2 * | 3/2005 | Hsieh | A45B 25/02 | 135/25.3 |
| 7,415,986 | B2 * | 8/2008 | Wu | A45B 25/22 | 135/31 |
| 9,668,553 | B2 * | 6/2017 | Haythornthwaite | A45B 25/02 | |
| 9,668,554 | B2 * | 6/2017 | Haythornthwaite | A45B 25/02 | |
| 9,788,617 | B1 * | 10/2017 | Chen | A45B 25/02 | |
| 2004/0238020 | A1 * | 12/2004 | Lee | A45B 25/22 | 135/31 |
| 2007/0107758 | A1 * | 5/2007 | Chen | A45B 25/22 | 135/27 |
| 2017/0215535 | A1 * | 8/2017 | Chen | A45B 25/02 | |
| 2017/0238662 | A1 * | 8/2017 | Haythornthwaite | A45B 25/22 | |

* cited by examiner

*Primary Examiner* — Noah Chandler Hawk

(57) ABSTRACT

An umbrella includes a shaft, a top cap and a runner. Multiple rib units and multiple stretchers are pivotably connected to the top cap and the runner. The rib units each have a first rib, a second rib and a third rib. The first, second and third ribs are pivotably connected in sequence. A canopy is mounted to the rib units. The second ribs each have a first connection portion on one end thereof, and the first connection portion has a seat which is connected to a link unit. The link unit has a joint which is connected to the third rib. The third rib has a positioning member to position the joint. The third rib and the joint are connected with each other to bear wind force applied to the second rib and the third rib, such that the second and third ribs do not deform.

5 Claims, 6 Drawing Sheets

WIND-PROOF UMBRELLA

BACKGROUND OF THE INVENTION

1. Fields of the Invention

The present invention relates to an umbrella, and more particularly, to a wind-proof umbrella.

2. Descriptions of Prior Art

The conventional umbrellas are used to against sun and rain, however, there are some inherent problems that are difficult to resolve for years. When using an umbrella in a windy day, the umbrella can easily flip inside out under a certain level of wind such 30 mph wind. This is partially because the canopy is so large that when wind blows from inside of the umbrella, the umbrella flips inside out. In a windy and rainy day, the result is the same as no umbrella is used.

The present invention intends to provide an umbrella which is designed to against wind so as to keep the canopy from flipping inside out.

SUMMARY OF THE INVENTION

The present invention relates to an umbrella and comprises a shaft having a top cap connected to the top end thereof. A runner is movably mounted to the shaft. Multiple rib units and multiple stretchers are pivotably connected to the top cap and the runner. The rib units each have a first rib, a second rib and a third rib. The first, second and third ribs are pivotably connected in sequence. A canopy is mounted to the rib units. The second ribs each have a first connection portion on one end thereof. The first connection portion has a seat which is connected to a link unit. The link unit has a joint which is connected to the third rib which has a positioning member to position the joint. The third rib and the joint are connected with each other to bear wind force applied to the second rib and the third rib, such that the second and third ribs do not deform.

Preferably, the joints each include multiple links which are located side by side. Two respective ends of each of the links are connected to each other. The links expand laterally to form a main part. One end of the main part is bent to form one or multiple openings.

Preferably, each of the joints is a sleeve connected to one end of the link unit. The sleeve is mounted to the third rib corresponding thereto. An open end of the sleeve is pivotably connected to the link unit.

Preferably, each of the joints is a bent end on one end of the link unit.

Preferably, the first ribs each have the first end connected to the top cap, and the second end of each first rib has a second connection portion. The second ribs each have a third connection portion on one end thereof, and the second connection portion is overlapped and connected to the third connection portion so as to form a support point.

Preferably, the umbrella is a foldable umbrella or a single shaft umbrella.

Specifically, the third rib and the joint are connected with each other to bear wind force applied to the second rib and the third rib, such that the second and third ribs do not deform when strong wind is applied to the umbrella. Therefore, the structural strength is enhanced and resolves problems of deformation of the ribs happened to the multiple-stage foldable umbrellas.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
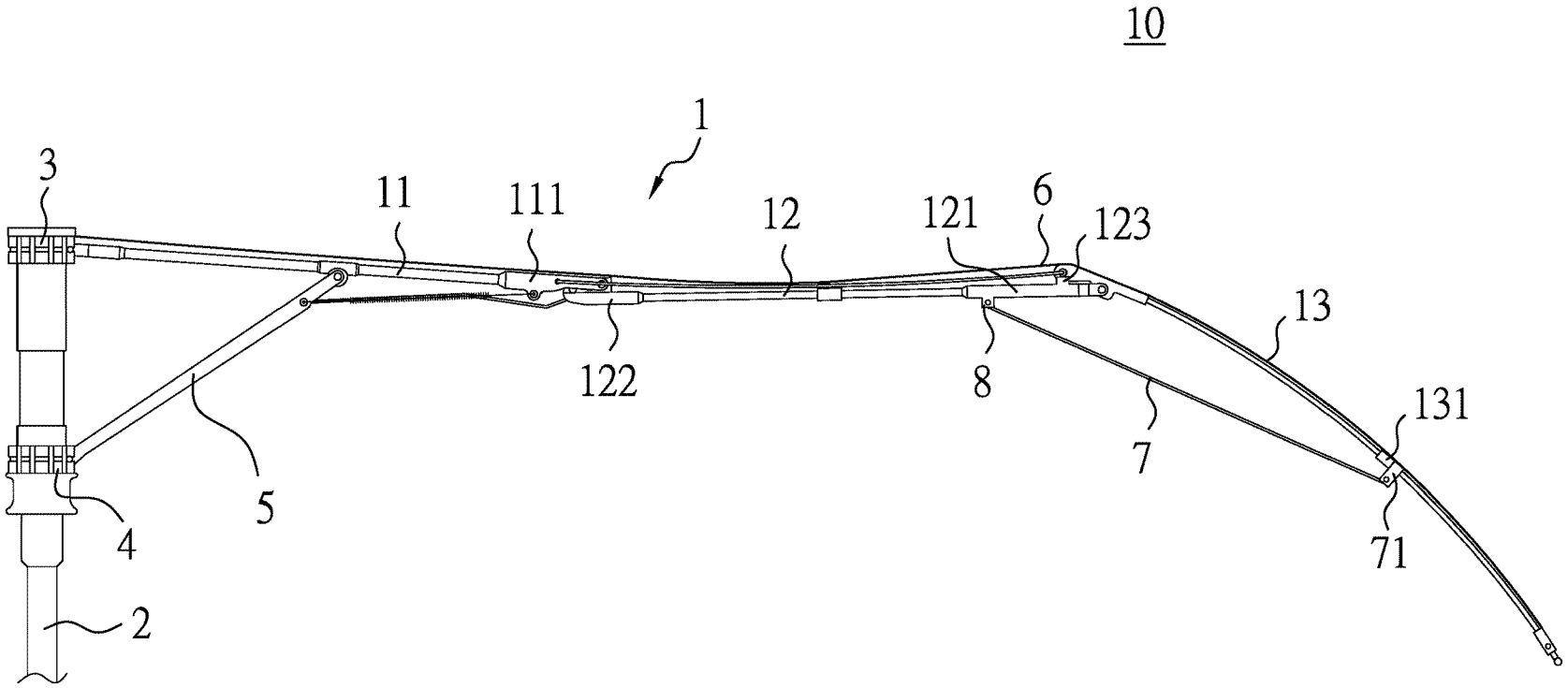
FIG. 1 is a side view to show a portion of the umbrella of the present invention.
Figure 2:
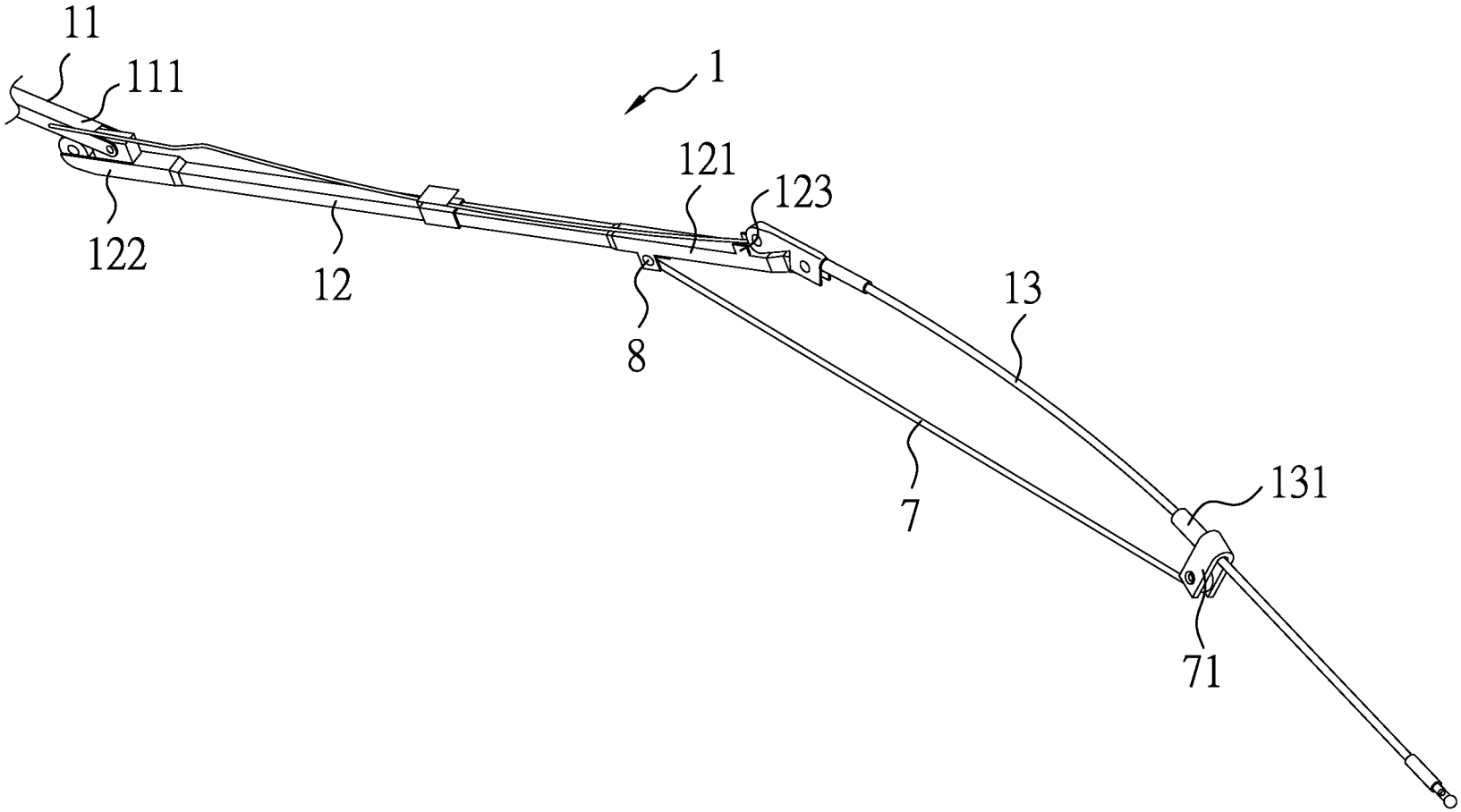
FIG. 2 shows the rib unit of the umbrella of the present invention.
Figure 7:
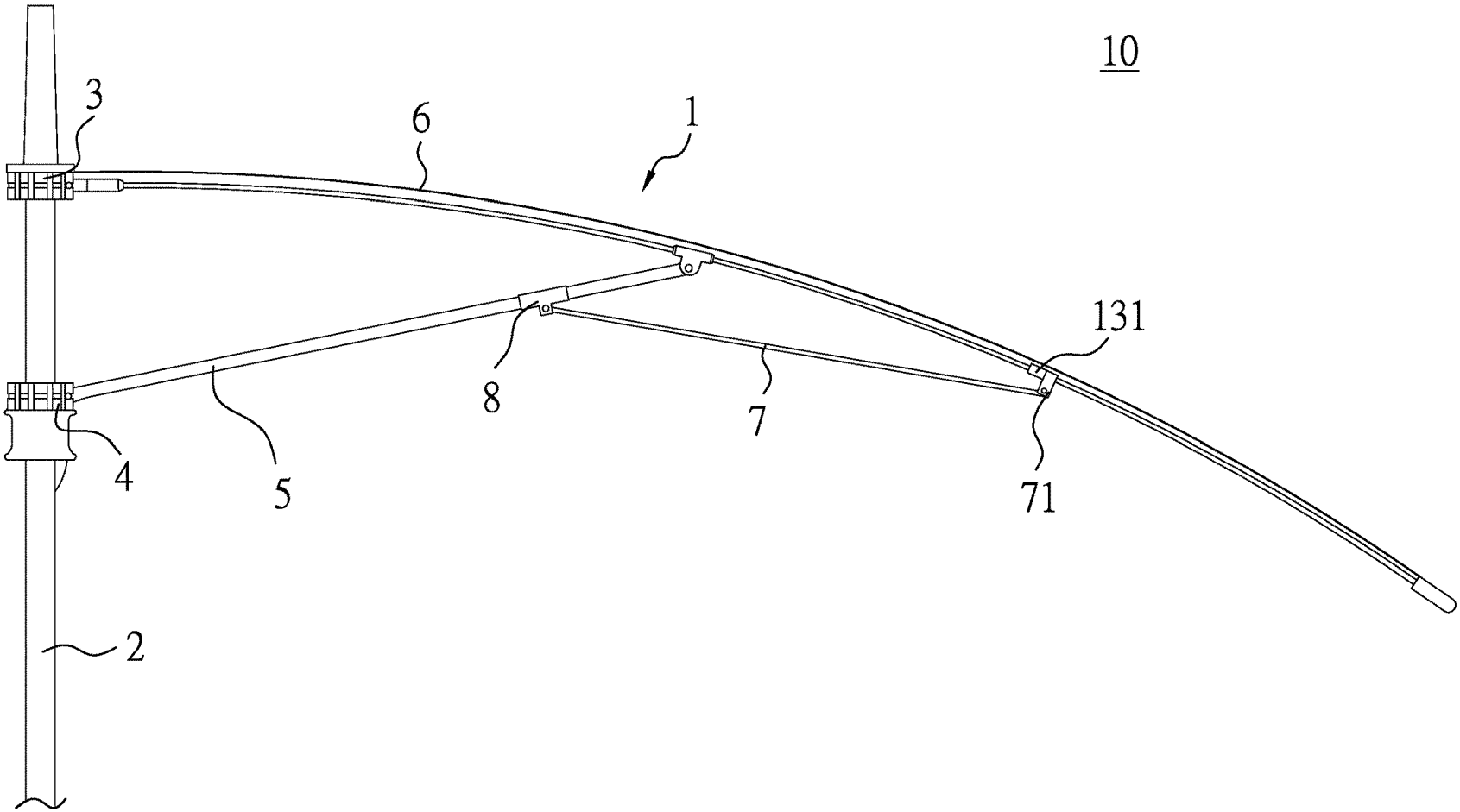
FIG. 7 is a cross sectional view to show that the umbrella of the present invention is a single-shaft umbrella.

Referring to FIGS. 1 and 2, the umbrella of the present invention is used for a multiple-stage foldable umbrella which is not limited to this present invention, the present invention can also be applied to the single-shaft umbrella as shown in FIG. 7.

The umbrella 10 comprises a shaft 2 having a top cap 3 connected to the top end thereof, and a runner 4 is movably mounted to the shaft 2. Multiple rib units 1 and multiple stretchers 5 are pivotably connected to the top cap 3 and the runner 4. The number of the rib units 1 and stretchers 5 is the same. The rib units 1 each have a first rib 11, a second rib 12 and a third rib 13. The first, second and third ribs 11, 12, 13 are pivotably connected in sequence. The length of each of the first, second and third ribs 11, 12, 13 may be different. A canopy 6 mounted to the rib units 1. The second ribs 12 each have a first connection portion 121 on one end thereof, and the first connection portion 121 is connected to the third rib 13. A protrusion 123 is formed at the connection between the first connection portion 121 and the third rib 13 so as to support one end of the third rib 13. The first connection portion 121 has a seat 8 which is connected to a link unit 7. The link unit 7 has a joint 71 which is connected to the third rib 13 which has a positioning member 131 so as to position the joint 71. The third rib 13 and the joint 71 are connected with each other to bear wind force applied to the second rib 12 and the third rib 13, such that the second and third ribs 12, 13 do not deform when wind is applied to the umbrella. The specific structure enhances the structural strength of the umbrella.

It is noted that the first ribs 11 each have the first end connected to the top cap 3, and the second end of each first rib 11 has a second connection portion 111. The second ribs 12 each have a third connection portion 122 on one end thereof, and the second connection portion 111 is overlapped and connected to the third connection portion 122 so as to form a support point.

Figure 3:
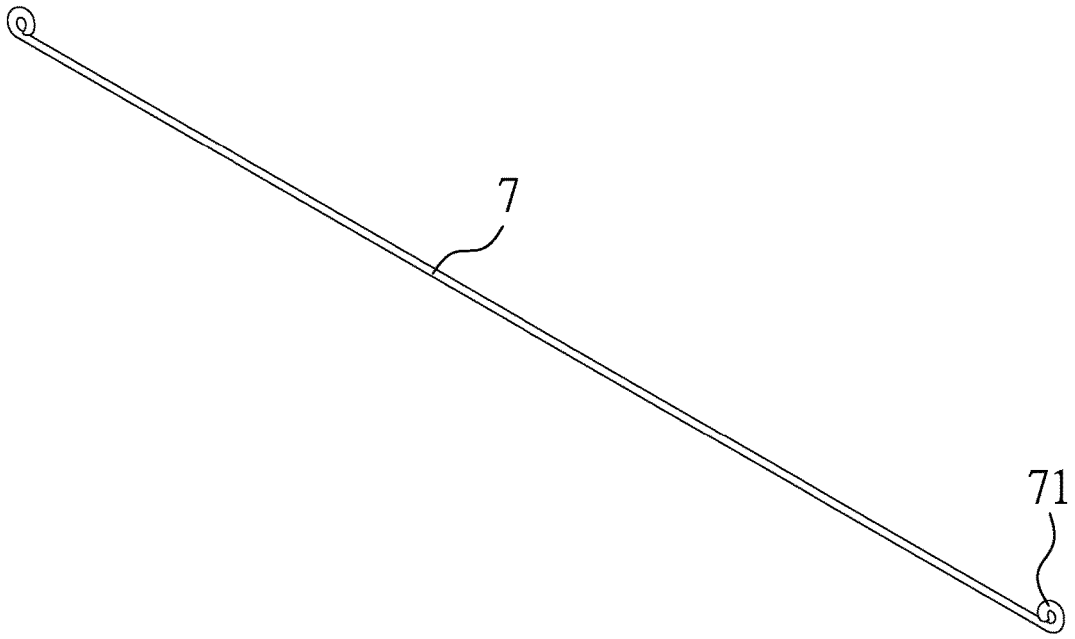
FIG. 3 shows the link unit of the umbrella of the present invention.

Each of the joints 71 is a bent end on one end of the link unit 7, this is just an example and does not limited to the present invention, the bent end forms a hole, as shown in FIG. 3, to allow one end of the link unit 7 to be mounted to the third rib 13. Alternatively, each of the joints 71 can be a sleeve connected to one end of the link unit 7. The sleeve is mounted to the third rib 13 corresponding thereto. The open end of the sleeve is pivotably connected to the link unit 7.

Figure 4:
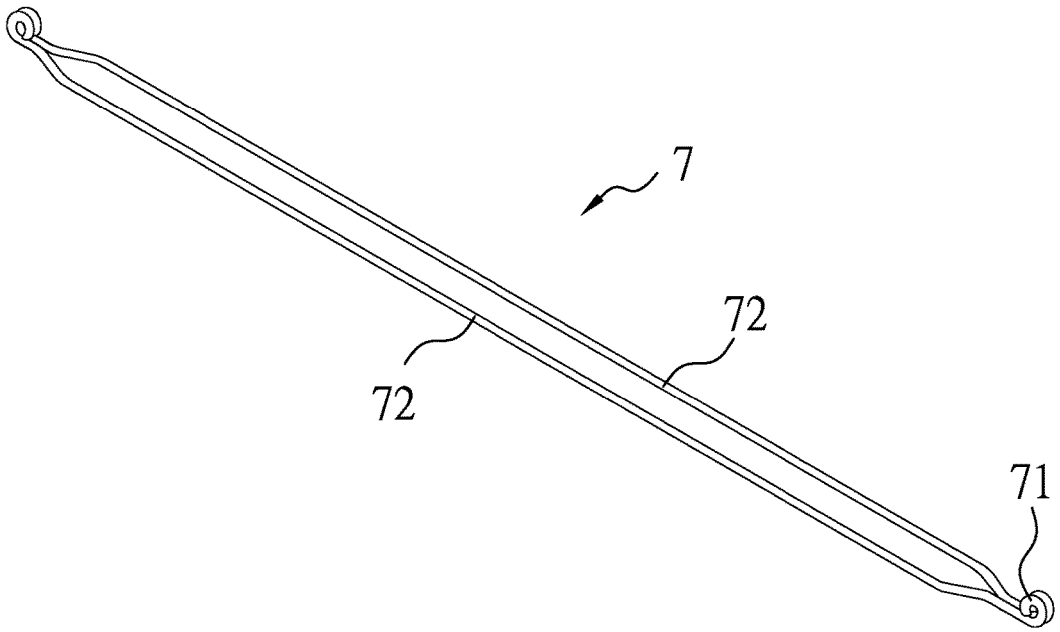
FIG. 4 shows the link unit is composed of two links.

The link unit 7 can be single one or multiple. The joints 71 each include multiple links which are located side by side, two respective ends of each of the links are connected to each other. The links expand laterally to form a main part 72, and one end of the main part 72 is bent to form one or multiple openings as shown in FIG. 4.

Figure 5:
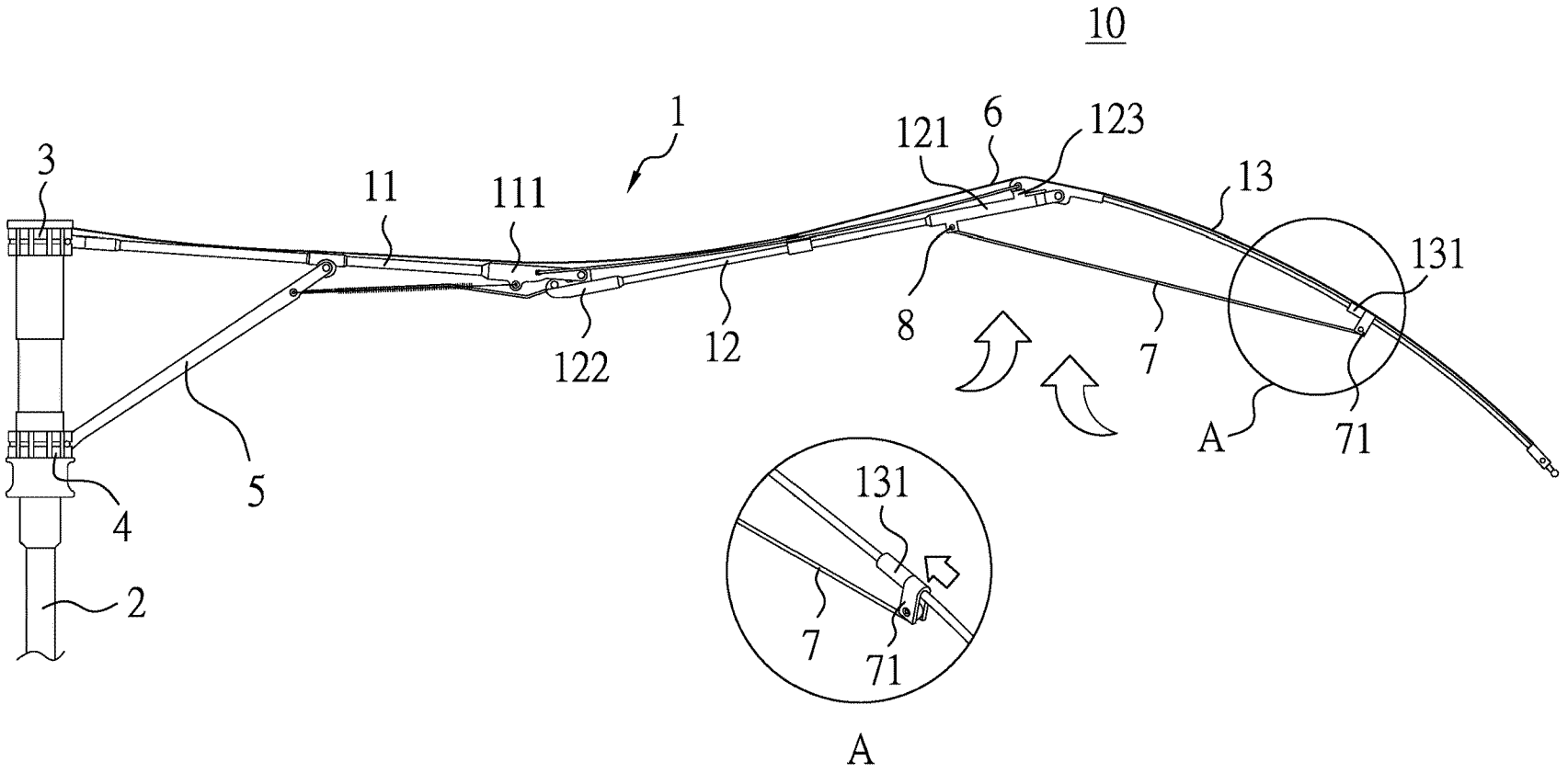
FIG. 5 shows the first status of the umbrella of the present invention that bears wind.

As shown in FIG. 5, when the present invention is applied to a multiple-stage foldable umbrella and wind is applied to the umbrella, assume that the third rib 13 flips upward, because the link unit 7 contacts the positioning member 131, the link unit 7 pulls the third rib 13, so that the connection point between the second connection portion 111 and the third connection portion 122 forms a support point which supports the second rib 12. Therefore, the force applied to the second rib 12 and the third rib 13 is released to protect the third rib 13 from being deformed.

Figure 6:
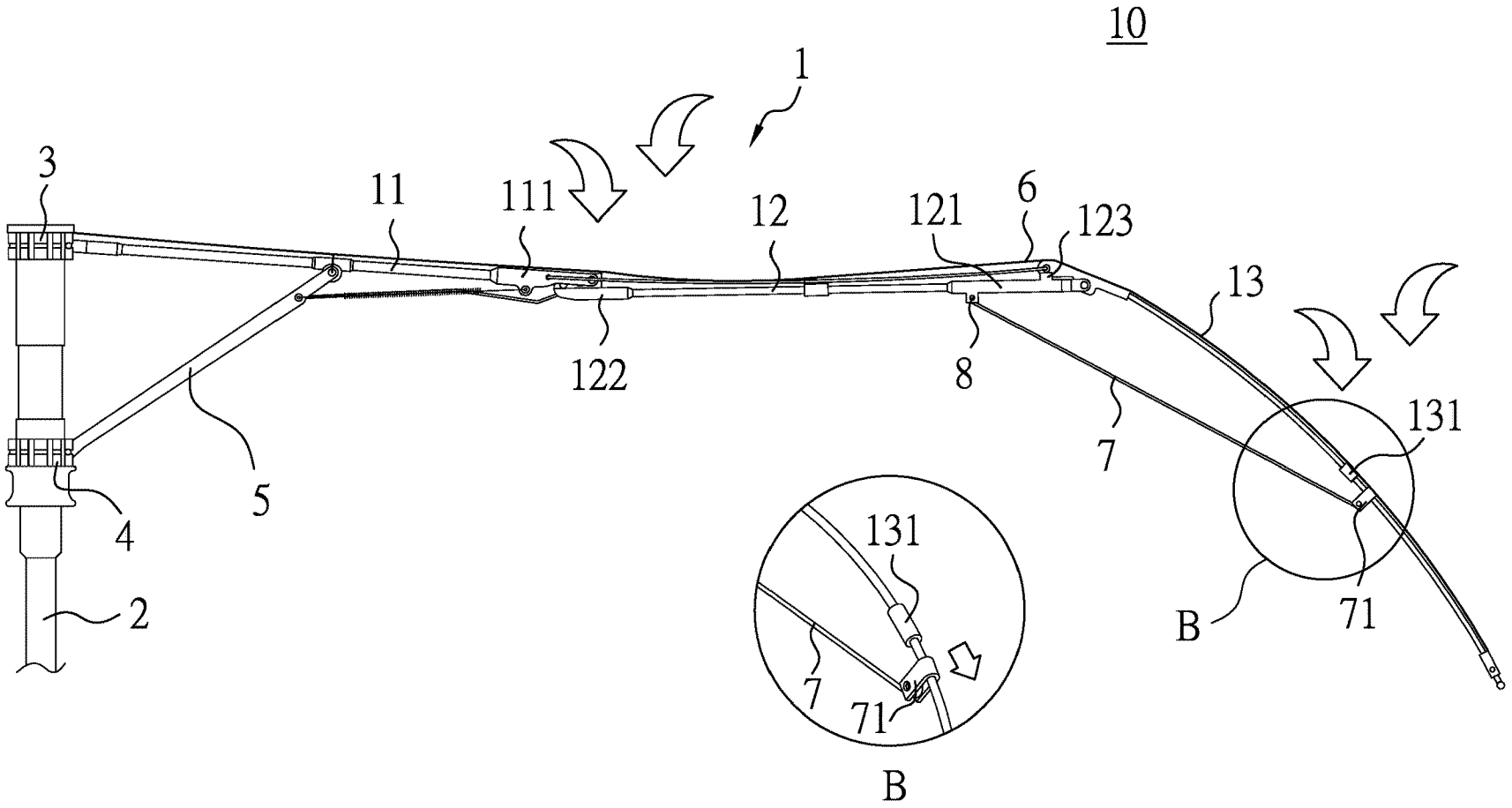
FIG. 6 shows the second status of the umbrella of the present invention that bears wind.

As shown in FIG. 6, when wind is applied to the umbrella, and the third rib 13 is pressed downward by wind, because the link unit 7 slides toward the periphery of the canopy 6 and is separated from the positioning member 131, so that the second connection portion 111 contacts the third connection portion 122 to support the second rib 12. The link unit 7 supports the third rib 13 to release the force applied to the second rib 12 and the third rib 13. The umbrella 10 of the present invention can bear strong wind.

As shown in FIG. 7, the umbrella 10 of the present invention is a single shaft umbrella. The umbrella 10 comprises a shaft 2 having a top cap 3 connected to the top end thereof, and a runner 4 is movably mounted to the shaft 2. Multiple rib units 1 and multiple stretchers 5 are pivotably connected to the top cap 3 and the runner 4. The number of the rib units 1 and stretchers 5 is the same. A canopy 6 mounted to the rib units 1. The rib unit 1 is a straight link. The stretcher 5 has a seat 8 which is connected to the link unit 7. The link unit 7 has a joint 71 which is connected to the rib unit 1 which has a positioning member 131 so as to position the joint 71. The rib unit 1 and the link unit 7 are connected with each other to bear wind force applied to the rib unit 1 and the stretcher 5, such that the rib unit 1 and the stretcher 5 do not deform when wind is applied to the umbrella.

While we have shown and described the embodiment in accordance with the present invention, it should be clear to those skilled in the art that further embodiments may be made without departing from the scope of the present invention.

What is claimed is:

1. An umbrella comprising:

a shaft having a top cap connected to a top end thereof;

a runner movably mounted to the shaft;

multiple rib units radially pivotably connected to the top, each of the rib units having a first rib, a second rib and a third rib, wherein an inner end and an outer end of the first rib are pivotably connected to the top cap and an inner end of the second rib respectively, an inner end and an outer end of the second rib are pivotably connected to the outer end of the first rib and an inner end of the third rib respectively, and an inner end of the third rib is pivotably connected to the outer end of the second rib;

multiple stretchers, radially pivotably connected to the runner, each stretcher being an independent piece, and two ends of each stretcher being separately pivotably connected between the runner and a middle section of one of the first ribs; and a canopy mounted to the rib units;

wherein the outer end of each of the second ribs is provided with a first connection portion connecting the inner end of one of the third ribs, the first connection portion has a pivoting seat which is connected to an end of a sliding link, another end of the sliding link has a slidable joint freely slidably connected to the third rib, the sliding link is a non-foldable rod without an intermediate foldable joint, and a positioning member is unmovably mounted on the third rib at an inner position from the slidable joint so as to block the slidable joint when the slidable joint moves inward.

2. The umbrella as claimed in claim 1, wherein the sliding link is formed by two parallel rods.

3. The umbrella as claimed in claim 1, wherein each of the slidable joints is a sleeve.

4. The umbrella as claimed in claim 1, wherein each of the first ribs has a first end connected to the top cap, and a second end of each first rib has a second connection portion, each of the second ribs has a third connection portion on one end thereof, and the second connection portion is overlapped with and connected to the third connection portion so as to form a support point.

5. The umbrella as claimed in claim 1, wherein the umbrella is a foldable umbrella or a single shaft umbrella.

* * * * *